US007001204B1

(12) United States Patent
Lin

(10) Patent No.: US 7,001,204 B1
(45) Date of Patent: Feb. 21, 2006

(54) TRANSMITTING JACK WITH PRONG-TYPE CONDUCTIVE PIECES

(75) Inventor: Yen-Lin Lin, Lu-Chou (TW)

(73) Assignee: JYH Eng Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 11/033,288

(22) Filed: Jan. 12, 2005

(51) Int. Cl.
*H01R 11/20* (2006.01)

(52) U.S. Cl. ..... 439/418

(58) Field of Classification Search ..... 439/417, 439/418, 425, 625, 626, 638, 686–691, 695–696, 439/701, 712, 724, 731
See application file for complete search history.

(56) References Cited

U.S. PATENT DOCUMENTS

| | | | | | |
|---|---|---|---|---|---|
| 444,450 | A * | 1/1891 | Huber | 81/135 |
| 2,673,968 | A * | 3/1954 | Smith | 439/417 |
| 3,879,099 | A * | 4/1975 | Shaffer | 439/397 |
| 4,693,539 | A * | 9/1987 | Tighe, Jr. | 439/465 |
| 4,726,785 | A * | 2/1988 | Kerboul et al. | 439/417 |
| 5,762,518 | A * | 6/1998 | Tanigawa et al. | 439/409 |
| 5,947,761 | A * | 9/1999 | Pepe | 439/409 |
| 6,116,943 | A * | 9/2000 | Ferrill et al. | 439/418 |
| 6,142,834 | A * | 11/2000 | Liao | 439/676 |
| 6,157,542 | A * | 12/2000 | Wu | 361/752 |
| 6,352,450 | B1 * | 3/2002 | Bronk et al. | 439/660 |
| 6,471,537 | B1 * | 10/2002 | Huang | 439/418 |
| 6,478,609 | B1 * | 11/2002 | Davis et al. | 439/470 |
| 6,682,363 | B1 * | 1/2004 | Chang | 439/409 |
| 6,869,297 | B1 * | 3/2005 | Caveney | 439/138 |
| 2004/0253882 | A1 * | 12/2004 | Fukatsu et al. | 439/752 |

* cited by examiner

*Primary Examiner*—Gary Paumen
*Assistant Examiner*—Larisa Tsukerman
(74) *Attorney, Agent, or Firm*—Troxell Law Office, PLLC

(57) ABSTRACT

In the transmitting jack, a housing has a seat for mounting multiple metallic electrically conductive pieces, and has a passage seat for extending therethrough of transmitting lines in a communication line. The transmitting lines are located in slots provided on the seat for the metallic electrically conductive pieces; prongs provided on the metallic electrically conductive pieces can be extended through insulating coats on the transmitting lines for electric conduction. The housing is pivotally connected with a pair of tailing seats enveloping the communication line. The tailing seats each has therein an inclined block; the blocks move along inclined surfaces on the tailing end of the passage seat when they are closed up to each other; and the tailing seats will push the passage seat frontwardly of the housing, so that the transmitting lines in the passage seat are pierced by the prongs for connecting. By this, there is no tool required for completing assembling of the entire jack.

9 Claims, 5 Drawing Sheets

TRANSMITTING JACK WITH PRONG-TYPE CONDUCTIVE PIECES

BACKGROUND OF THE INVENTION

1. Field of the Invention

The present invention is related to a new structure of high-speed signal transmitting jack with prong-type electrically conductive pieces, and especially to a transmitting jack capable of being assembled without any tool.

2. Description of the Prior Art

Cable network transmitting available nowadays can only be completed by inputting to computers with communication cables. There are eight transmitting lines in a communication cable, in addition to these, the transmitting lines are coated with insulating coats. The communication cables must use transmitting jacks to get connecting into the computers, such as use RJ45 connectors, so that data can be input into the computers or uploaded from the computers.

A conventional jack structure has passage ways in its insulation housing for extending of transmitting lines therein, then metallic electrically conductive pieces can thus be connected. Generally used metallic electrically conductive pieces are preferably prong types, by virtue that the tailing ends of metallic electrically conductive pieces have sharp prongs able to directly pierce the insulating coats of transmitting lines to contact a central core line for electric connecting.

However, conventional designing for a jack structure must use some particular tools to finish piercing of metallic electrically conductive pieces through the transmitting lines, this not only increases working hours for assembling the jack, but also is not benefit to the cost of working.

Besides, a conventional structure of transmitting jack with prong-type electrically conductive pieces is unable to be detached after being assembled; so that the entire jack structure must be removed to change for a new jack structure if its metallic electrically conductive pieces are damaged or loosened after using for a long time, this is extremely disadvantageous for maintenance and protecting.

In view of these, the conventional jack structure evidently has its defects and is expected to be improved.

SUMMARY OF THE INVENTION

The primary object of the present invention is to provide a transmitting jack with prong-type electrically conductive pieces free of an assembling tool, the structure is pivotally connected on its housing with a pair of openable/closable tailing seats—an upper and a lower tailing seat—for enveloping transmitting lines. The upper and the lower tailing seats each is provided therein with an inclined block; the two inclined blocks will move along inclined surfaces on the tailing end of a passage seat when they are closed to each other, and then are closed together; when in closing, the upper and the lower tailing seats will push a passage seat frontwardly of the housing, so that the transmitting lines in the passage seat are pierced by prongs of metallic electrically conductive pieces for connecting. By this, there is no tool required for completing assembling of the entire jack, and thereby time efficiency can be largely increased and cost of production can be reduced.

Another object of the present invention is to provide a transmitting jack with prong-type electrically conductive pieces free of an assembling tool, wherein the inclined blocks form sections of gaps with the inner walls of the upper and the lower tailing seats, so that the inclined blocks have flexibility for moving along the inclined surfaces and for closing and engaging, thereby assembling of the structure can be easy.

Another object of the present invention is to provide a transmitting jack with prong-type electrically conductive pieces free of an assembling tool, wherein the top and the bottom surfaces of the housing are provided on the rear edges of them each with a hooking piece to abut against the front edges of the upper and the lower tailing seats, in order to limit the upper and the lower tailing seats from opening for an overly large angle, this is also for the convenience of assembling.

The present invention will be apparent in its features of structure and effect of operation after reading the detailed description of the preferred embodiment thereof in reference to the accompanying drawings.

DETAILED DESCRIPTION OF THE PREFERRED EMBODIMENT

Figure 1:
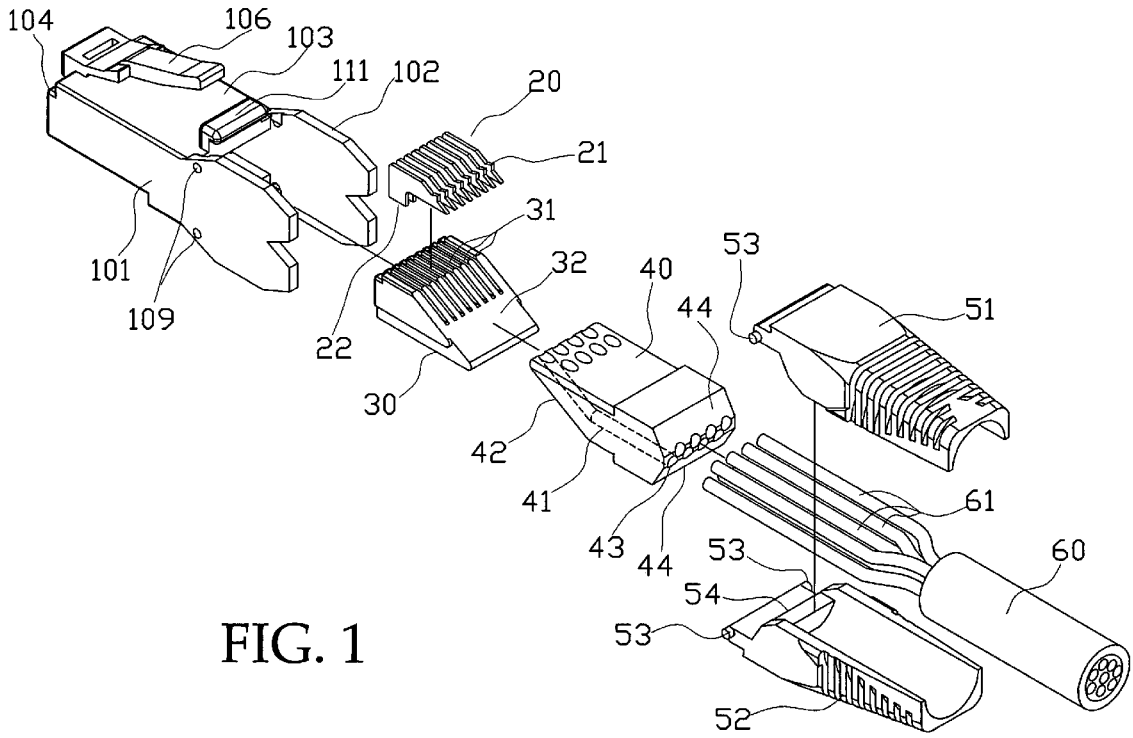
FIG. 1 is an anatomic perspective view of the present invention.
Figure 2:
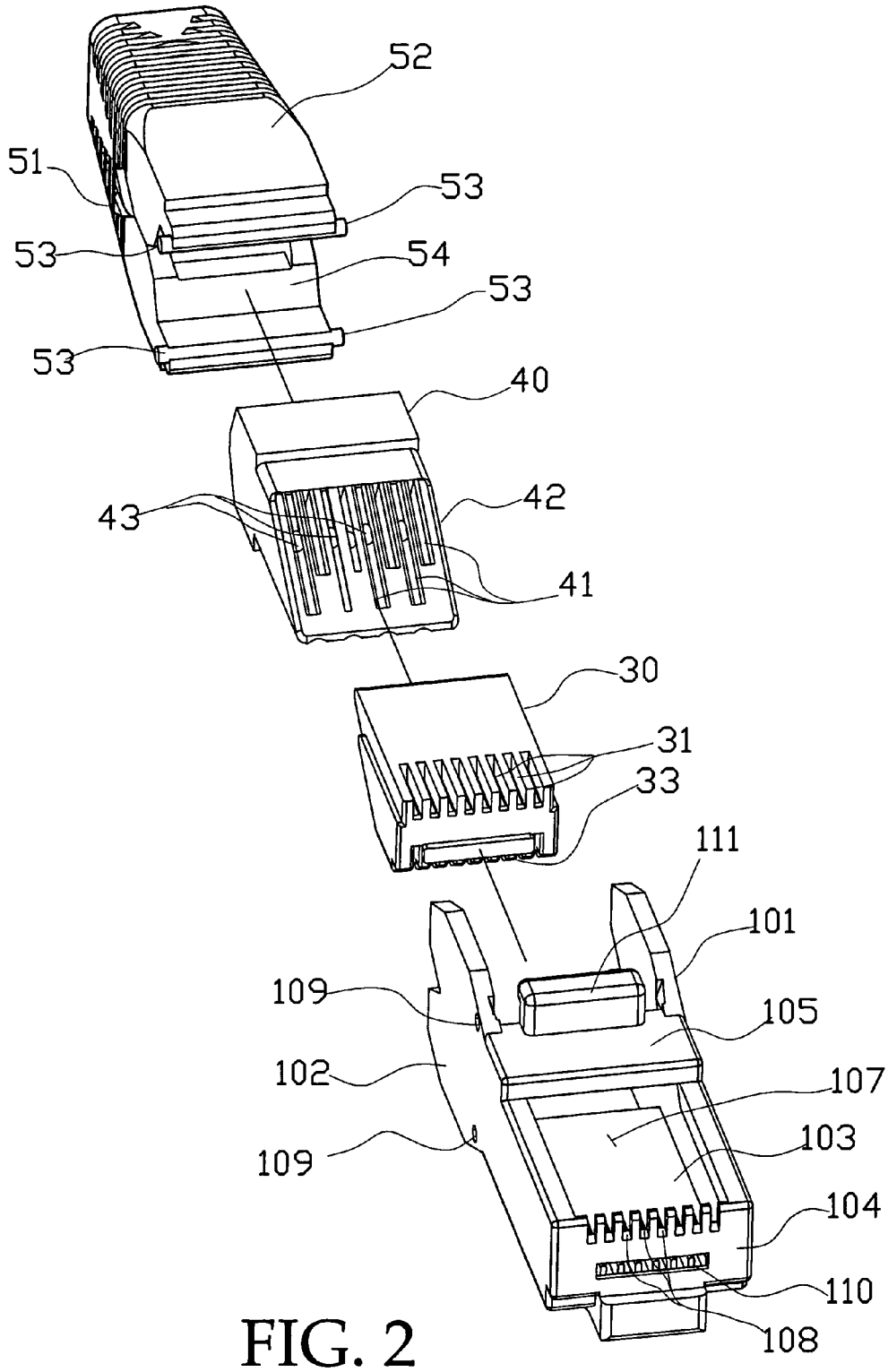
FIG. 2 is a partial anatomic perspective view of the present invention from another viewing angle.
Figure 3:
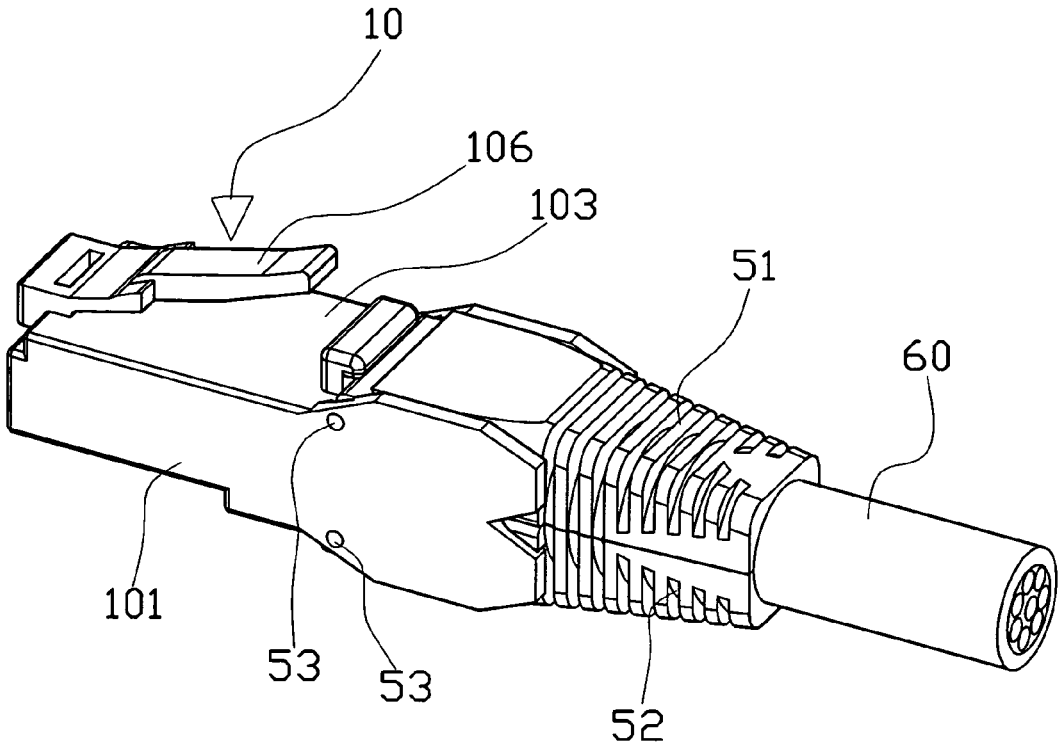
FIG. 3 is a perspective view of the present invention after assembling.

Referring to FIGS. 1–3, the present invention has an insulation housing 10; the insulation housing 10 has a front section that can be inserted into a jack hole of a communication jack, and has two lateral sides 101 and 102, a top surface 103, a front surface 104, and a bottom surface 105 (reference to FIG. 2).

There is an elastic clamping strip 106 on the top surface 103 for fixing of a plug in the jack.

The two lateral sides 101 and 102 have their top edges connected to the top surface 103, and have their bottom edges connected to the bottom surface 105. The bottom surface 105 and the front surface 104 are formed therebetween an empty area 107.

The front surface 104 is provided with an elongate hole 110, and is provided on its bottom edge with a plurality of slits 108.

The two lateral sides 101 and 102 are provided each with a round hole 109 to pivotally connect an upper and a lower tailing seat 51, 52.

The insulation housing 10 is provided therein with a seat 30 for the electrically conductive pieces 20, the seat 30 is provided on the front thereof with a plurality of vertically running through slots 31 for mounting a plurality of metallic electrically conductive pieces 20, the metallic electrically conductive pieces 20 are inserted each into a slot 31 to have a bottom edge 22 of each of the metallic electrically conductive pieces 20 assembled in the empty area 107 formed between the bottom surface 105 and the front surface 104 of the insulation housing 10 to contact a pin of the jack.

And the seat 30 is provided on its rear side with an inclined surface 32, a plurality of prongs 21 on the metallic electrically conductive pieces 20 in the slots 31 protrude out of the inclined surface 32. The seat 30 is provided on its front side with a protruding strip 33 which exactly is inserted into the elongate hole 110 on the front surface 104 of the housing 10; thereby an effect of positioning is obtained.

At the rear of the seat 30 in the housing 10, there is a communication-line passage seat 40 having therein a plurality of passage ways 41 for extending through of transmitting lines 61 in the communication line 60. The passage seat 40 is formed on its front bottom edge also an inclined surface 42 in corresponding to the inclined surface 32, so that after extending of the transmitting lines 61 through the passage ways 41, the tailing ends of the transmitting lines 61 are exactly located on the inclined surface 42 and able to be pierced by the prongs 21 of the metallic electrically conductive pieces 20 getting through openings 43 of the passage ways 41, and contact for electric conducting can thus be attained.

The end surface of the passage seat 40 is divided from a middle horizontal intersection line into an upper and a lower inclined surface 44 symmetrical to each other.

The housing 10 has at its rear the upper and the lower tailing seats 51, 52 which each is provided on its front end with a couple of protruding axles 53 extendible through the round holes 109 provided on the two lateral sides 101 and 102 of the housing 10 to get an object of pivotally connecting. The upper and the lower tailing seats 51, 52 can be mutually closed and engaged for enveloping the tailing end of the communication line 60.

Figure 4:
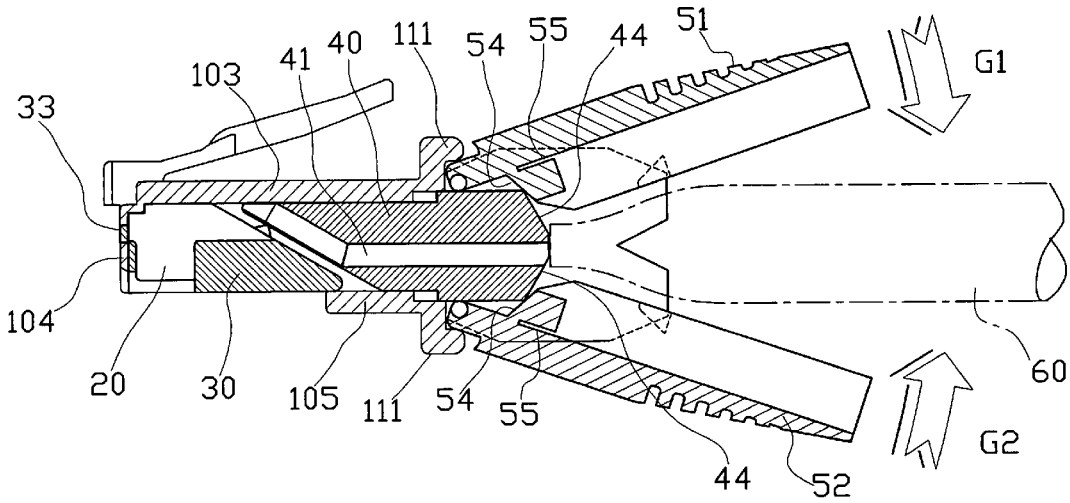
FIG. 4 is a sectional view of the present invention showing the opening state of an upper and a lower tailing seat.
Figure 5:
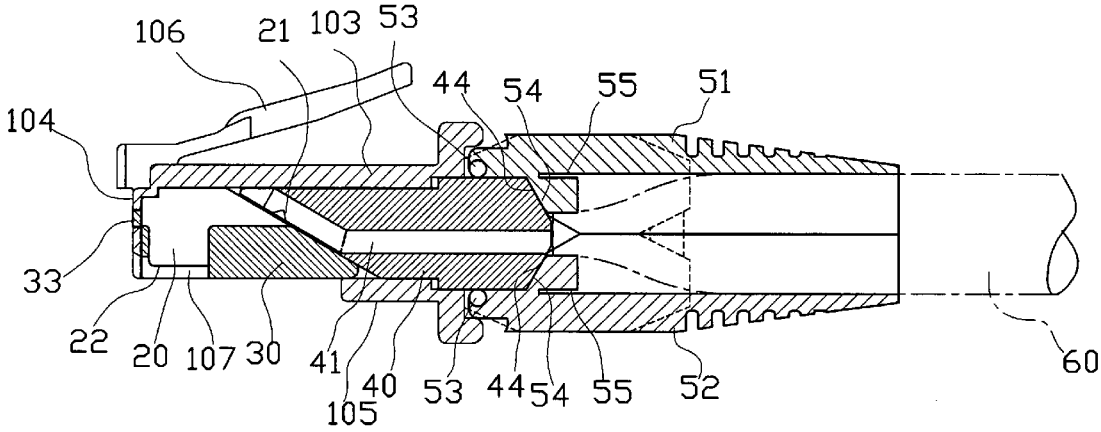
FIG. 5 is a sectional view of the present invention showing the closing state of the upper and the lower tailing seats.

The upper and the lower tailing seats 51, 52 each is provided therein with an inclined block 54; referring to FIGS. 4 and 5, the inclined blocks 54 will move along the inclined surfaces 44 on the tailing end of the passage seat 40 when they are closed to each other, and then the upper and the lower tailing seats 51, 52 can envelop the tailing end of the communication line 60 by contact of the inclined blocks 54 with the inclined surfaces 44.

Referring to FIGS. 4 and 5, when in closing together of the upper and the lower tailing seats 51, 52, the inclined blocks 54 will push the passage seat 40 toward the front surface 104 of the housing 10, so that the transmitting lines 61 on the passage seat 40 will be connected with the prongs 21 of the metallic electrically conductive pieces 20 extending through the openings 43 of the passage ways 41.

Further, one thing is worth noticing, the inclined blocks 54 in the upper and the lower tailing seats 51, 52 form sections of gaps 55 with the inner walls of the upper and the lower tailing seats 51, 52 (referring to FIGS. 4 and 5), so that the inclined blocks 54 have flexibility for moving along the inclined surfaces 44 and for closing and engaging.

Moreover, the present invention is provided on the top surface 103 and the bottom surface 105 of the insulation housing 10 on their rear edges each with a raised hooking piece 111 to abut against the front edges of the upper and the lower tailing seats 51, 52, in order to limit the upper and the lower tailing seats 51, 52 from opening for an overly large angle.

When in assembling the transmitting jack of the present invention, the upper and the lower tailing seats 51, 52 can be pivotally connected to the round holes 109 provided on the two lateral sides 101 and 102 of the housing 10, and are separated from each other to the position as being opened as is shown in FIG. 4. Then metallic electrically conductive pieces 20 are inserted into the slots 31 of the seat 30, and then the metallic electrically conductive pieces 20 and the seat 30 are together put into the housing 10 from the rear end of the latter to render the protruding strip 33 on the front side of the seat 30 to be inserted into and positioned in the elongate hole 110 on the front surface 104 of the housing 10. Thereafter, the transmitting lines 61 of the communication line 60 are inserted respectively into the passage ways 41 of the passage seat 40, then the passage seat 40 and the communication line 60 are put in from the rear end of the housing 10.

Subsequently, as shown by the arrows G1 and G2 in FIG. 4, the upper and the lower tailing seats 51, 52 are pivoted about the protruding axles 53 for closing and engaging with each other to get the engaging position as shown in FIG. 5.

When in closing and engaging of the upper and the lower tailing seats 51, 52, as is stated hereinbefore, the inclined blocks 54 in them will push the passage seat 40 frontwardly, so that the prongs 21 of the metallic electrically conductive pieces 20 automatically pierce the transmitting lines 61 to complete electric conduction.

It is evidently that when in assembling the transmitting jack provided in the present invention, no tool is required to complete contact of the prongs 21 of the metallic electrically conductive pieces 20 with the wires in the transmitting lines 61, thereby the time efficiency of production can be largely increased and cost can be reduced.

And the present invention has another advantage, i.e., when the metallic electrically conductive pieces 20 or the transmitting lines 61 in the housing 10 are damaged, it needs only to separate the upper and the lower tailing seats 51, 52 to open, the metallic electrically conductive pieces 20 can be changed or the transmitting lines 61 can be trimmed, and then the entire jack can be reassembled by one self.

In conclusion, the structure of the innovated transmitting jack provided in the present invention is far better than a conventional structure.

I claim:

1. A transmitting jack with prong-type electrically conductive pieces free of an assembling tool, said jack is provided in a communication line enveloping a plurality of transmitting lines and comprises:

an insulation housing having a front section for inserting into a jack hole of a communication jack;

a plurality of metallic electrically conductive pieces each having thereon a prong;

a seat for said electrically conductive pieces, said seat is provided on the front of said insulation housing and is provided with a plurality of slots for mounting said electrically conductive pieces, said prongs of said metallic electrically conductive pieces are inserted each into a corresponding one of said slots and protrude out of an upper surface of said seat;

a passage seat having therein a plurality of passage ways for extending through of said transmitting lines, tailing ends of said transmitting lines are located on said prongs of said metallic electrically conductive pieces, an end surface of said passage seat is divided from its middle area into an upper and a lower inclined surface; and an upper and a lower tailing seat of which front edges are respectively pivotally connected with said insulation housing for opening and closing for engaging with each other, when in closing for engaging, said tailing seats envelop said communication line;

wherein said upper and lower tailing seats each is provided therein with an inclined block; said inclined blocks move along inclined surfaces on a tailing end of said passage seat when they are closed to each other, and then are closed together; and said upper and lower tailing seats push a passage seat frontwardly of said housing, so that said transmitting lines in said passage seat are pierced by said prongs of said metallic electrically conductive pieces for electrically conduction.

2. The transmitting jack with prong-type electrically conductive pieces free of an assembling tool as claimed in claim 1, wherein said insulation housing has two lateral sides, a top surface, a front surface and a bottom surface; an empty area is formed between said bottom surface and said front surface for receiving bottom edges of said metallic electrically conductive pieces.

3. The transmitting jack with prong-type electrically conductive pieces free of an assembling tool as claimed in claim 2, wherein an elastic clamping strip is provided on said top surface for fixing of a plug in said jack.

4. The transmitting jack with prong-type electrically conductive pieces free of an assembling tool as claimed in claim 2, wherein said front surface is provided with an elongate hole for inserting and positioning of a protruding strip provided on a front side of said seat for said electrically conductive pieces.

5. The transmitting jack with prong-type electrically conductive pieces free of an assembling tool as claimed in claim 2, wherein said front surface is provided on its bottom edge with a plurality of slits.

6. The transmitting jack with prong-type electrically conductive pieces free of an assembling tool as claimed in claim 2, wherein said two lateral sides of said housing are provided each with a round hole to pivotally connect a couple of protruding axles respectively of said upper tailing seat and said lower tailing seat.

7. The transmitting jack with prong-type electrically conductive pieces free of an assembling tool as claimed in claim 1, wherein said passage seat is divided from a middle horizontal intersection line into an upper and a lower inclined surface symmetrical to each other.

8. The transmitting jack with prong-type electrically conductive pieces free of an assembling tool as claimed in claim 1, wherein said inclined blocks in said upper tailing seat and said lower tailing seat form sections of gaps with inner walls of said upper and said lower tailing seats.

9. The transmitting jack with prong-type electrically conductive pieces free of an assembling tool as claimed in claim 1, wherein said top and the bottom surfaces of said housing are provided on their rear edges each with a hooking piece to abut against said front edges of said upper and lower tailing seats, in order to limit said upper and the lower tailing seats from opening for an overly large angle.

* * * * *